US008428292B2

(12) United States Patent
Shaffer et al.

(10) Patent No.: US 8,428,292 B2
(45) Date of Patent: Apr. 23, 2013

(54) VEHICLE AUDIO SYSTEM HAVING PORTABLE POWERED SPEAKER FOR CONNECTING A PORTABLE ENTERTAINMENT DEVICE

(75) Inventors: Aric David Shaffer, Ypsilanti, MI (US); Ronald Hugh Miller, Saline, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1314 days.

(21) Appl. No.: 12/131,059

(22) Filed: May 31, 2008

(65) Prior Publication Data

US 2009/0296955 A1 Dec. 3, 2009

(51) Int. Cl.
*H04R 1/02* (2006.01)

(52) U.S. Cl.
USPC ..... 381/389; 381/86; 381/302

(58) Field of Classification Search ..... 381/86, 381/87, 386–389, 333–334, 302; 181/150, 181/151; 455/569.2, 569.1
See application file for complete search history.

(56) References Cited

U.S. PATENT DOCUMENTS

| | | | | |
|---|---|---|---|---|
| 2,866,891 | A | 12/1958 | Princ | |
| 3,071,728 | A | 1/1963 | Grace et al. | |
| 3,134,945 | A | 5/1964 | Wertheimer | |
| 4,020,284 | A | 4/1977 | Phillips | |
| 4,546,850 | A | 10/1985 | Litner | |
| 4,756,454 | A | 7/1988 | Villanueva et al. | |
| 4,807,292 | A * | 2/1989 | Sorscher | 381/86 |
| 5,048,089 | A | 9/1991 | Moore | |
| 5,273,243 | A | 12/1993 | Abdallah et al. | |
| 5,864,627 | A * | 1/1999 | Kim | 381/86 |
| 6,091,225 | A * | 7/2000 | Kim et al. | 320/114 |
| 6,731,761 | B1 * | 5/2004 | Zablocki et al. | 381/86 |
| 6,782,239 | B2 * | 8/2004 | Johnson et al. | 455/42 |
| 6,798,892 | B2 | 9/2004 | Parnell | |
| 7,184,259 | B2 | 2/2007 | Marler et al. | |
| 7,239,237 | B2 | 7/2007 | Hess | |
| 7,313,247 | B1 | 12/2007 | Tilli et al. | |
| 7,906,938 | B2 * | 3/2011 | Yang | 320/114 |
| 2004/0162029 | A1 | 8/2004 | Grady | |
| 2006/0119104 | A1 | 6/2006 | Wall | |
| 2006/0155545 | A1 | 7/2006 | Jayne | |
| 2008/0031483 | A1 * | 2/2008 | Hill | 381/334 |
| 2008/0055408 | A1 | 3/2008 | Wun | |

* cited by examiner

*Primary Examiner* — Disler Paul
(74) *Attorney, Agent, or Firm* — Frank A. MacKenzie; Brooks Kushman P.C.

(57) ABSTRACT

A vehicle audio system includes an interior trim panel having an opening with a speaker module removably secured therein and having a speaker electrically connected to the vehicle audio system when the speaker module is positioned within the opening. The speaker module includes an interface for receiving an audio signal from a linked portable electronic device for playing the audio signal through the speaker when the speaker module is removed from the interior trim panel opening and electrically disconnected from the vehicle audio system, and for playing the audio signal through the vehicle audio system when the speaker module is positioned within the interior trim panel. The speaker module may include an energy storage device and/or generator, such as a dynamo or solar cell, to power the speaker and play audio from a linked digital media player and/or recharge an electronic device, such as a media player or cell phone.

17 Claims, 3 Drawing Sheets

VEHICLE AUDIO SYSTEM HAVING PORTABLE POWERED SPEAKER FOR CONNECTING A PORTABLE ENTERTAINMENT DEVICE

BACKGROUND

1. Technical Field

The present disclosure relates to an audio system for a vehicle having a portable powered speaker with a wired or wireless connection for a portable media player.

2. Background Art

As travelers and commuters spend an increasing amount of time in various types of vehicles, such as automobiles, trucks, RV's, buses, airplanes, watercraft, trains, and the like, more comfort, convenience, and entertainment systems are becoming standard or optionally available equipment. As consumer electronic devices become smaller and more portable, more travelers have become accustomed to bringing them along on trips of both limited and lengthy duration. Digital media players in particular have become ubiquitous traveling companions. Portable and desktop devices such as clock/radios, CD players, and the like now have docking stations for interfacing with media players that allow users to listen to audio through speakers of the device while recharging the device battery. Likewise, various vehicle manufacturers now include wired and/or wireless interfaces to couple digital media players, cell phones, and other devices to the vehicle audio system, usually through the radio. This allows users to listen to and share audio from a coupled electronic device through the more powerful and typically better quality vehicle speakers.

SUMMARY

A vehicle audio system includes an interior trim panel having an opening with a speaker module removably secured therein and including a speaker electrically connected to the vehicle audio system when positioned within the opening, the speaker module including an interface for receiving an audio signal from a linked portable electronic device and playing the audio signal through the speaker when the speaker module is removed from the interior trim panel opening and electrically disconnected from the vehicle audio system.

In one embodiment, the speaker module includes an energy storage device and a generator connected to the energy storage device for generating power when the speaker module is removed from the vehicle. The energy storage device may be implemented by a capacitor or a rechargeable battery with the generator implemented by a solar cell, dynamo, or Faraday induction device, for example. Various embodiments provide for recharging of the portable electronic device through the associated interface using vehicle power when the speaker module is installed in the interior trim panel and using the energy storage device and/or generator when the speaker module is removed from the interior trim panel. The speaker module may also include one or more auxiliary power ports for charging other accessories when connected and/or disconnected from the vehicle.

A method according to one embodiment of the present disclosure comprises positioning a portable speaker module including a speaker connected to a power supply and generator disposed within the module into a corresponding opening in an interior trim panel of a vehicle to removably electrically connect the speaker to an audio system of the vehicle and to secure the speaker module to the interior trim panel of the vehicle. The method may also include removing the speaker module from the opening in the interior trim panel to electrically disconnect the speaker from the audio system of the vehicle and provide a portable powered speaker for interfacing with an associated electronic entertainment device. In one embodiment, the method includes coupling a portable media player to the speaker module to play audio signals from the portable media player through the speaker powered by the power supply within the speaker module when the speaker module is disconnected from the vehicle audio system.

The present disclosure includes embodiments having various advantages. For example, embodiments according to the present disclosure provide a removable speaker module for a vehicle audio system that includes an energy storage device and/or generator to provide a portable speaker system for a linked personal/portable electronic device. When installed in the vehicle, the speaker module integrates seamlessly with the interior trim and may provide one or more charging or docking stations to link a personal electronic device to the vehicle audio system and/or recharge the personal electronic device. When removed from the vehicle, the speaker module according to the present disclosure provides a portable powered speaker to facilitate playback of audio from a linked electronic device and may be used to charge the electronic device or other portable device, such as a cell phone.

The above advantages and other advantages and features will be readily apparent from the following detailed description of the preferred embodiments when taken in connection with the accompanying drawings.

DETAILED DESCRIPTION OF THE PREFERRED EMBODIMENT(S)

As those of ordinary skill in the art will understand, various features of the present disclosure as illustrated and described with reference to any one of the Figures may be combined with features illustrated in one or more other Figures to produce embodiments of the present disclosure that may not be explicitly illustrated or described. The combinations of features illustrated provide representative embodiments for typical applications. However, various combinations and modifications of the features consistent with the teachings of the present disclosure may be desired for particular applications or implementations.

Figure 1:
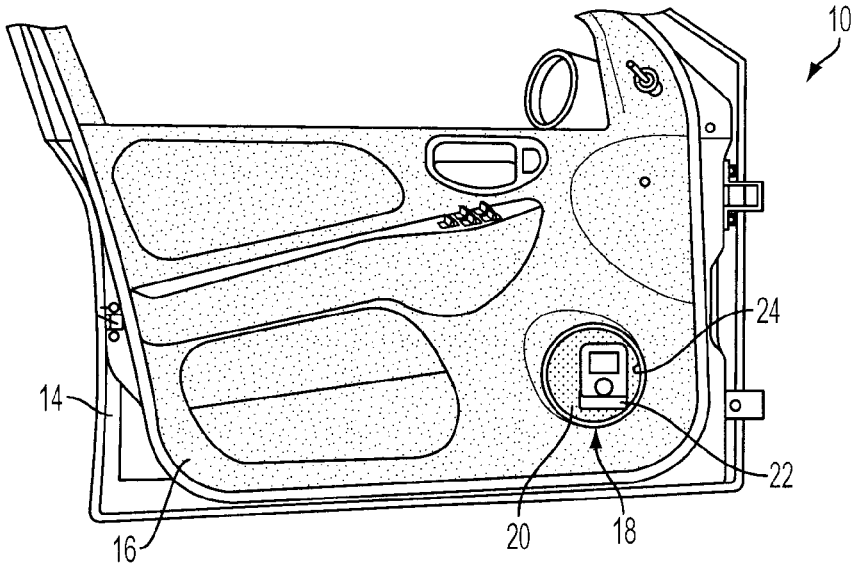
FIG. 1 illustrates a representative vehicle audio system having a removable speaker module according to one embodiment of the present disclosure.
Figure 2:
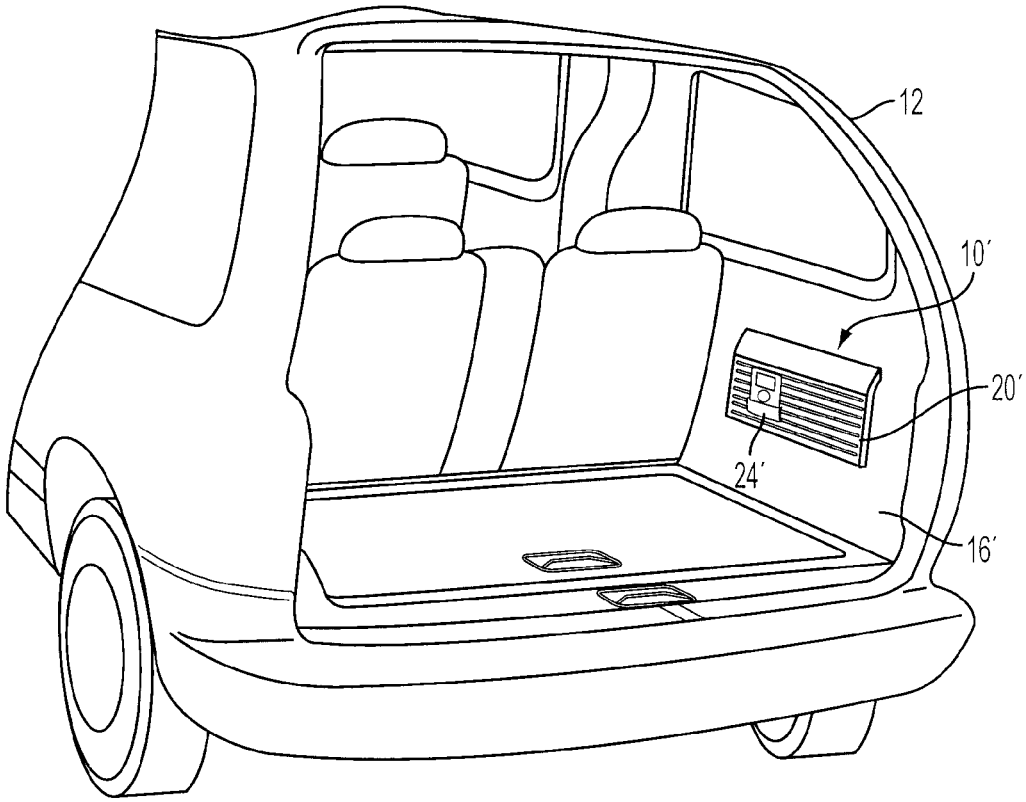
FIG. 2 illustrates an alternative embodiment of a vehicle audio system having a removable speaker module according to the present disclosure.

In the representative embodiments illustrated in FIGS. 1 and 2, a vehicle audio system 10 is illustrated in an automotive vehicle 12. Of course, the audio system of the present disclosure may be used in various other types of land, air, and sea vehicles, for example. Audio system 10 generally includes a plurality of fixed speakers (not specifically illustrated) and at least one removable speaker module 20 connected to an audio signal source, such as a radio, CD player, entertainment system, navigation system, etc., all of which are well known in the art. As shown in FIG. 1, a door 14 of a vehicle includes an interior trim panel 16 having an opening 18 adapted to secure a removable speaker module 20. As illustrated and described in greater detail herein, speaker module 20 is electrically connected to vehicle audio system 10 when positioned within opening 18 as shown in FIG. 1. Speaker module 20 includes an interface 22 for receiving an audio signal from a linked portable electronic device 24, such as a digital media player, mp3 player, video player, or the like. Depending upon the particular application and implementation, speaker module 20 may be configured to couple the audio output from electronic device 24 to the vehicle audio system 10 when speaker module 20 is positioned within opening 18. When speaker module 20 is removed from opening 18 it is electrically disconnected from vehicle audio system 10 and audio from portable electronic device 24 is played through an associated speaker (best illustrated in FIG. 5) within speaker module 20.

FIG. 2 illustrates an alternative embodiment of a speaker system 10' having a removable speaker module 20' with a rectangular form factor and disposed within an opening in an interior trim panel 16' in the rear portion of vehicle 12. Although removable speaker modules 16, 16' are illustrated with round and rectangular form factors and positioned in a door panel and rear interior panel, respectively, those of ordinary skill in the art will recognize that the removable speaker module of the present disclosure is not limited to any particular shape or location within the vehicle. One or more removable speaker modules may be provided in a particular vehicle and may be positioned within various locations of the vehicle to provide users with a desired sound field, accessibility, convenience, aesthetics, etc. Each removable speaker module may include a cover (FIGS. 3, 4) that coordinates with the surrounding interior trim panels 16, 16' of the vehicle such that the removable speaker modules resemble other speakers of vehicle audio system 10 when the speaker modules are positioned within corresponding trim panel openings.

Figure 3:
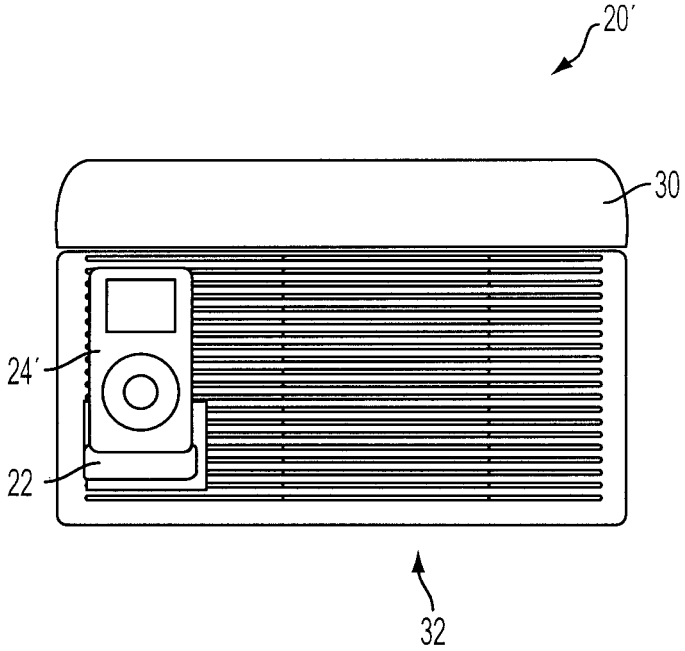
FIG. 3 is a front view of a representative removable speaker module for a vehicle with a linked personal electronic device according to one embodiment of the present disclosure.
Figure 4:
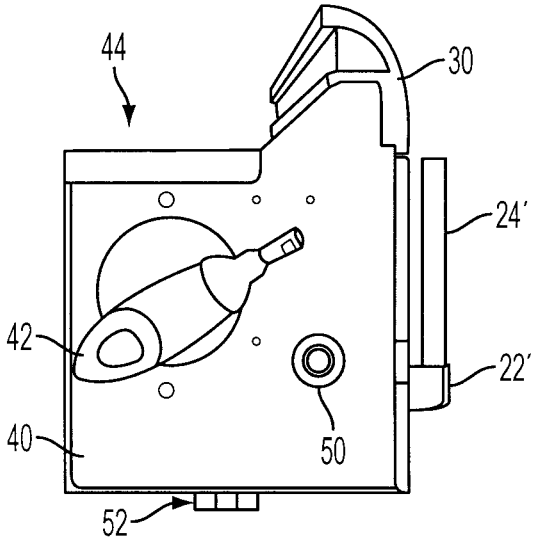
FIG. 4 is a side view of a representative removable speaker module for a vehicle illustrating a dynamo with folding crank for providing portable power according to one embodiment of the present disclosure.

FIG. 3 is a front view and FIG. 4 is a left-side view of one embodiment of a removable speaker module 20' with a linked portable electronic device 24' coupled to interface 22' after removal of the speaker module from a corresponding interior trim panel opening of a vehicle. In the embodiment of FIGS. 3 and 4, speaker module 20' includes a cover or grille 30 having at least one opening 32 to accommodate one or more speakers (not specifically illustrated). Cover 30 is secured to a housing 40 that includes a power generating device implemented by a DC generator or dynamo with a foldable crank 42. One or more power generating devices may be used to provide power for charging of electronic device 24' when speaker module 20' is removed from the interior trim panel opening of the vehicle. In one embodiment, one or more solar cells are provided on a top surface 44 of housing 40 to provide primary or supplementary power generating capability. Housing 40 may also include one or more energy storage devices, such as a battery and/or capacitor(s) as illustrated and described with reference to FIG. 5.

As also illustrated in FIG. 4, housing 40 may include one or more sockets, plugs, or connectors 50 coupled to a power generating device within housing 40 for charging or powering an auxiliary electronic device, such as a cell phone, for example. A second connector or plug 52 may be provided on the top, bottom, or side of housing 40 to automatically couple removable speaker module 20' to audio system 10 (FIGS. 1 and 2) of the vehicle when speaker module 20' is positioned within a corresponding opening in an interior trim panel.

Figure 5:
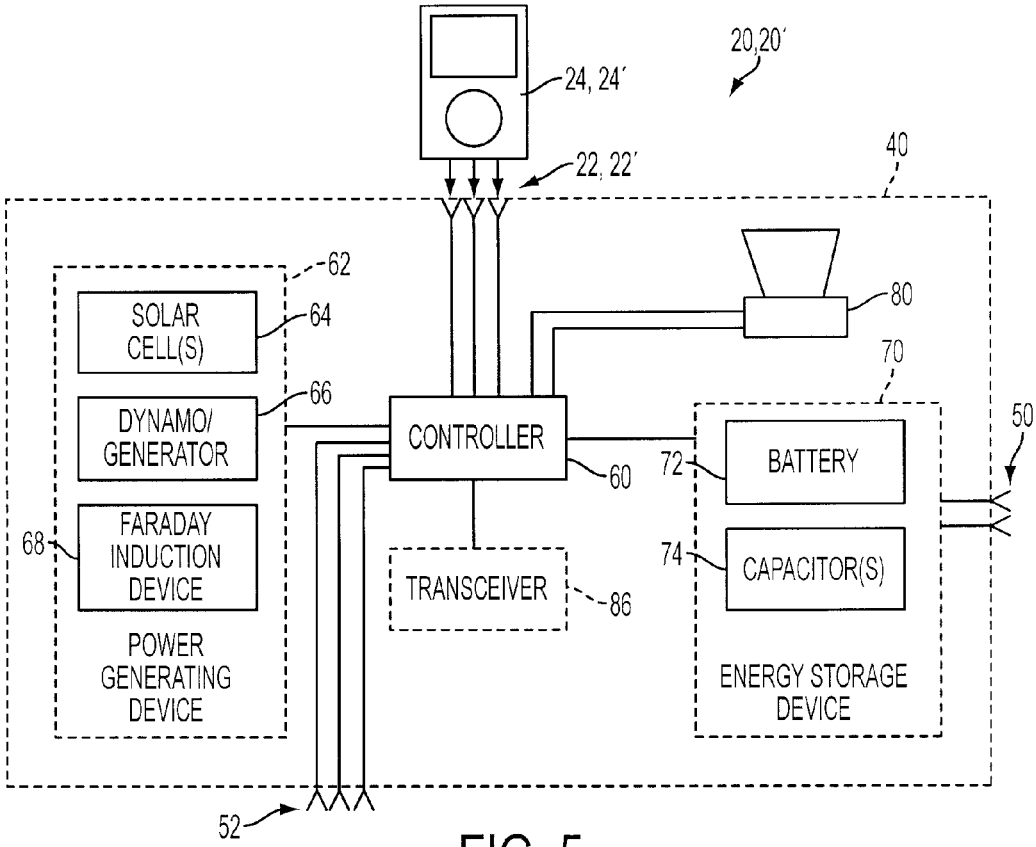
FIG. 5 is a block diagram of a representative embodiment of a removable speaker module for a vehicle with a portable power supply according to the present disclosure.

FIG. 5 is a simplified block diagram illustrating a representative embodiment of a removable speaker module 20, 20' according to the present disclosure. Speaker module 20, 20' may include a housing 40 having a controller 60, which may be implemented by a programmable microprocessor, microcontroller, or one or more controller circuits depending upon the particular application and implementation. Controller 60 may control power and audio signal flow through the speaker module 20, 20' in response to whether an audio signal and/or power is provided through interface 22, 22' from a linked portable electronic device 24, 24' and/or through first connector 52 from the vehicle audio system. For example, when speaker module 22, 22' is positioned within a corresponding opening in the vehicle trim panel and connected to the vehicle audio system through connector 52, power from the vehicle may be provided to controller 60 to charge energy storage device 70 in addition to powering speaker 80. An audio signal may be provided by portable electronic device 24, 24' through an optional wireless link using transceiver 86, or through a connector/plug implementation of interface 22, 22'.

As illustrated in the block diagram of FIG. 5, embodiments of speaker module 20, 20' that include a power generating device 62 may include one or more devices to provide power when speaker module 20, 20' is removed from the vehicle and electrically disconnected from the vehicle audio system 10. Power generating devices may include solar cells 64, a dynamo or mechanically operated DC generator 66, or a Faraday induction device 68, for example. Power generated by device(s) 62 may be stored in an energy storage device 70 for use in powering speaker 80 and/or in charging an electronic device through interface 22, 22' and/or auxiliary power plug 50. Power to auxiliary plug 50 may be provided by energy storage device 70 and/or power generating device 62 when speaker module 20, 20' is disconnected from the vehicle audio system. When speaker module 20, 20' is positioned within the interior trim panel opening and electrically connected to the vehicle audio system, power from the vehicle audio system may be supplied to auxiliary connector/plug 50 from connector 52. Similarly, power from the vehicle audio system may be used to charge energy storage device 70 while connected for subsequent use when disconnected.

Energy storage device 70 may be implemented by one or more batteries 72 and/or one or more capacitors 74, for example. Depending upon the particular application and implementation, a linked electronic device 24, 24' may have sufficient power to drive speaker 80 directly using its own internal battery or other power source. In these applications, power generating device 62 and energy storage device 70 would be unnecessary, or would not be used.

In operation, speaker module 20, 20' has a first connector 52 accessible through housing 40 that engages a corresponding connector of a vehicle audio system 10 when housing 40 is positioned within an opening of an interior trim panel of the vehicle. The connectors may be designed such that proper positioning of housing 40 within a corresponding opening in the interior trim panel engages or couples the connectors to provide an electrical connection to the vehicle audio system without any additional steps by the user. Similarly, removal of housing 40 from the opening disconnects connector 52 to disconnect speaker module 20, 20' from the vehicle audio system. At least one speaker 80, which is at least partially disposed within housing 40, and electrically connected to first connector 52 is used to generate sound from an audio signal provided by the vehicle audio system through connector 52 when housing 40 is positioned within the interior trim panel opening. A second connector 22, 22' may be incorporated into a docking station secured to housing 40 to link portable electronic device 24, 24' to the at least one speaker 80 to play audio from the portable electronic device when speaker module 20, 20' is removed from the interior trim panel opening. Optionally, audio from a linked portable electronic device 24, 24' may be played through the vehicle audio system and speaker 80 when speaker module 20, 20' is positioned within a corresponding interior trim panel opening.

As previously described, energy storage device 70 is disposed within housing 40 and electrically connected to at least one speaker 80, to first connector 52, and to second connector 22, 22'. In the representative embodiment illustrated in FIG. 5, the connections are routed through controller 60 although various other implementations are possible, which may include various direct or indirect connections to provide a removable powered speaker module according to the present disclosure.

Figure 6:
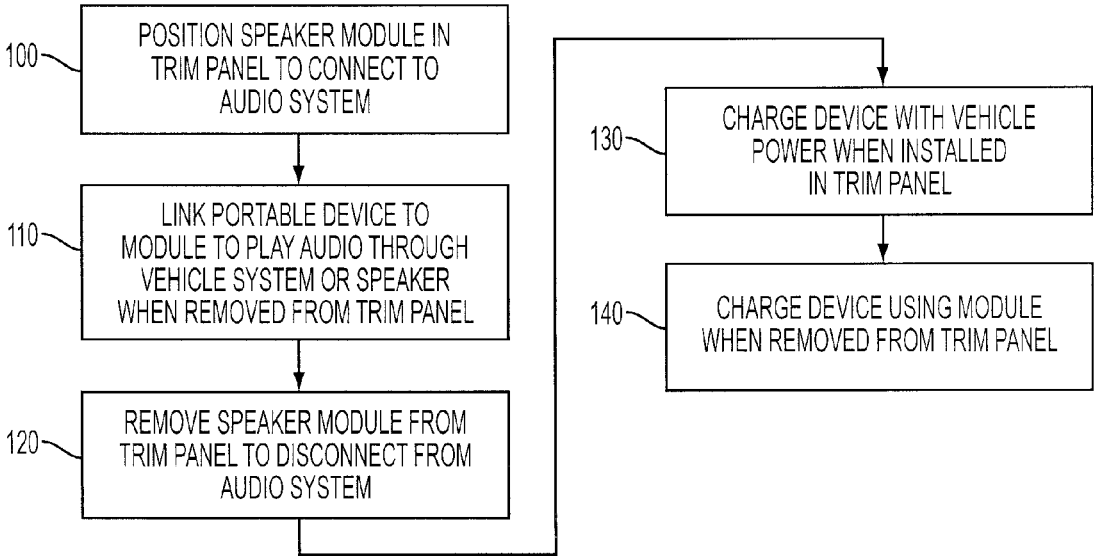
FIG. 6 is a flow chart illustrating a representative embodiment of a method according to the present disclosure.

FIG. 6 illustrates a method for providing a removable speaker module for a vehicle audio system according to one embodiment of the present disclosure. The method includes positioning a portable speaker module including a speaker connected to an energy storage device and a power generating device disposed within the module into a corresponding opening in an interior trim panel of a vehicle to removably electrically connect the speaker to an audio system of the vehicle and to secure the speaker module to the interior trim panel of the vehicle as represented by block 100. A portable electronic device is linked to the speaker module to play audio from the portable electronic device through the audio system of the vehicle when the speaker module is positioned within the opening in the interior trim panel and to play audio through the speaker when the speaker module is removed from the interior trim panel of the vehicle as represented by block 110. The method may also include removing the speaker module from the opening in the interior trim panel to electrically disconnect the speaker from the audio system of the vehicle and provide a portable speaker for the linked electronic device as represented by block 120.

In one embodiment, a method according to the present disclosure includes charging a portable electronic device linked to the speaker module using power from the vehicle audio system when the speaker module is positioned within the interior trim panel opening as represented by block 130. The method may also include charging a linked portable electronic device or auxiliary device using power from the speaker module when the speaker module is removed from the interior trim panel opening as represented by block 140. Power may be provided by the removable speaker module from an internal energy storage device and/or power generating device as previously described.

As such, embodiments according to the present disclosure provide a removable speaker module for a vehicle audio system that may include an energy storage device and/or power generating device to provide a portable speaker system for a linked personal/portable electronic device. When installed in the vehicle, the speaker module integrates seamlessly with the interior trim and may provide one or more charging or docking stations to link a personal electronic device to the vehicle audio system and/or recharge the personal electronic device as well as an auxiliary device. When removed from the vehicle, the speaker module provides a portable speaker to facilitate playback of audio from a linked electronic device and may be used to charge the electronic device or other portable device, such as a cell phone.

While the best mode has been described in detail, those familiar with the art will recognize various alternative designs and embodiments within the scope of the following claims. Various embodiments have been described with some embodiments described as providing advantages or being preferred over other embodiments and/or prior art devices in regard to one or more desired characteristics. However, as one skilled in the art is aware, one or more characteristics may be compromised to achieve desired overall system attributes, which depend on the specific application. These attributes include, but are not limited to: cost, strength, durability, life cycle cost, marketability, appearance, packaging, size, serviceability, weight, manufacturability, ease of assembly, etc. Any embodiments described herein as being less desirable in one aspect or another to other embodiments and/or prior art devices with respect to one or more characteristics are not outside the scope of the disclosure.

What is claimed:

1. A vehicle audio system comprising:

an interior trim panel having an opening; and a speaker module securable within the opening having a speaker selectively electrically connected to generate sound from an audio signal provided by the vehicle audio system, to an energy storage device for charging a hand-held portable device, and to an interface for receiving and playing an audio signal from the hand-held portable device through the speaker when removed from the opening.

2. The system of claim 1 wherein the energy storage device comprises a battery.

3. The system of claim 1 wherein the speaker module further comprises a power generating device connected to the energy storage device.

4. The system of claim 3 wherein the power generating device comprises a solar cell.

5. The system of claim 3 wherein the power generating device comprises a dynamo.

6. The system of claim 1 wherein the speaker module connects the audio signal from the hand-held portable device to the vehicle audio system when the speaker module is positioned within the interior trim panel opening to play the audio signal through the vehicle audio system.

7. The system of claim 1 wherein the speaker module connects power from the vehicle to the hand-held portable device when the speaker module is positioned within the interior trim panel opening to charge the portable electronic device from the vehicle.

8. The system of claim 1 wherein the interface comprises a connector for holding the hand-held portable device and electrically connecting the portable device to the speaker module.

9. The system of claim 1 wherein the interface comprises a transceiver for wirelessly linking the hand-held portable device to the speaker module.

10. A removable speaker module for a vehicle audio system, the speaker module comprising:

a housing having a first connector that engages a corresponding connector of a vehicle audio system when the housing is positioned within an opening of an interior trim panel of the vehicle;

at least one speaker at least partially disposed within the housing and electrically connected to the first connector for playing audio from the vehicle audio system when the housing is positioned within the opening; and a docking station secured to the housing and having a second connector connected to the at least one speaker for linking a portable electronic device to the at least one speaker to play audio from the portable electronic device when the speaker module is removed from the opening.

11. The speaker module of claim 10 further comprising a cover secured to the housing and including at least one opening for the at least one speaker, the cover coordinating with the interior trim panel of the vehicle such that the speaker module resembles other speakers of the vehicle audio system when the speaker module is positioned within the opening of the interior trim panel.

12. The speaker module of claim 10 further comprising an energy storage device disposed within the housing and electrically connected to the at least one speaker and to the first connector of the housing and the second connector of the docking station.

13. The speaker module of claim 12 wherein the energy storage device comprises a battery.

14. The speaker module of claim 13 further comprising a power generating device connected to the energy storage device and operable to generate electric power when the speaker module is removed from the interior trim panel opening.

15. The speaker module of claim 12 wherein the energy storage device comprises a solar cell.

16. A method comprising:

positioning a portable speaker module including a speaker connected to an energy storage device and a power generating device disposed within the module into a corresponding opening in an interior trim panel of a vehicle to removably electrically connect the speaker to an audio system of the vehicle to generate sound from an audio signal provided by the vehicle audio system and to secure the speaker module to the interior trim panel of the vehicle;

linking a portable electronic device to the speaker module to play audio from the portable electronic device through the audio system of the vehicle when the speaker module is positioned within the opening in the interior trim panel and to play audio through the speaker when the speaker module is removed from the interior trim panel of the vehicle;

charging the portable electronic device using power from the vehicle when the speaker module is positioned within the interior trim panel opening; and charging the portable electronic device using power from the speaker module when the speaker module is removed from the interior trim panel opening.

17. The method of claim 16 further comprising:

removing the speaker module from the opening in the interior trim panel to electrically disconnect the speaker from the audio system of the vehicle and provide a portable speaker for the linked electronic device.

* * * * *